US007498501B1

(12) United States Patent
Hsieh

(10) Patent No.: US 7,498,501 B1
(45) Date of Patent: Mar. 3, 2009

(54) SNARE-ADJUSTING DEVICE FOR A SNARE DRUM

(75) Inventor: Wu-Hong Hsieh, Lu Chou (TW)

(73) Assignee: K.H.S. Musical Instrument Co., Ltd., Lu Chou, Taipei Hsien (TW)

( * ) Notice: Subject to any disclaimer, the term of this patent is extended or adjusted under 35 U.S.C. 154(b) by 0 days.

(21) Appl. No.: 11/970,208

(22) Filed: Jan. 7, 2008

(51) Int. Cl.
*G10D 13/02* (2006.01)

(52) U.S. Cl. ..... 84/415

(58) Field of Classification Search ..... 84/415
See application file for complete search history.

(56) References Cited

U.S. PATENT DOCUMENTS 4,339,982 A * 7/1982 Hoshino ..... 84/415
5,557,053 A * 9/1996 Nickel ..... 84/415
6,093,877 A * 7/2000 Nickel ..... 84/415
6,958,440 B2 * 10/2005 Yu-Hwa ..... 84/415
7,220,905 B2 * 5/2007 Takegawa ..... 84/415
7,439,433 B1 * 10/2008 Hsieh ..... 84/415
2007/0079686 A1 * 4/2007 Hsieh ..... 84/415
2008/0264234 A1 * 10/2008 Hsieh ..... 84/415

* cited by examiner

*Primary Examiner*—Walter Benson
*Assistant Examiner*—Robert W Horn
(74) *Attorney, Agent, or Firm*—patenttm.us

(57) ABSTRACT

A snare-adjusting device is mounted on a snare drum for adjusting tension of a snare and has a base, adjustment assembly and snare mount. The adjustment assembly is mounted through the base and has a barrel, shaft, slider, adjustment head and friction ring. The barrel has two ends. The shaft is mounted rotatably through the barrel. The slider is mounted slidably in and engages one end of the barrel and is mounted on the shaft using threads. The adjustment head is mounted securely on the shaft. The friction ring is mounted slidably through an other end of the barrel, is pressed by a resilient device to abut the adjustment head and provide friction against rotation of the adjustment head. The snare mount is attached to the slider and connects to the snare. The friction holds the adjustment head securely to maintain a steady timbre.

7 Claims, 6 Drawing Sheets

SNARE-ADJUSTING DEVICE FOR A SNARE DRUM

BACKGROUND OF THE INVENTION

1. Field of the Invention

The present invention relates to a snare-adjusting device for a snare drum, and more particularly to a snare-adjusting device that maintains tension of a snare steadily.

2. Description of Related Art

Snare drums are percussion instruments used in drum kits and for marching bands.

With reference to FIG. 6, a conventional snare drum has a drum body, a snare and a conventional snare-adjusting device (80).

The drum body is an open cylinder having an annular sidewall and skins mounted over each opening. One skin is a contact skin, one skin is a snare skin.

The snare is mounted over and abuts the snare skin of the drum body for adjusting a timbre of the snare drum and has two ends. The two ends are mounted on the annular sidewall opposite to each other, at least one is mounted adjustably.

The snare-adjusting device (80) is mounted on the annular sidewall of the drum body, is attached to one of the ends of the snare to adjust the timbre of the snare drum by adjusting a tension of the snare and has a base (81) and a fastening assembly (82).

The base (81) is hollow, is mounted on the annular sidewall of the drum body and has a contact end and a snare end.

The fastening assembly (82) is mounted slidably through the base (81) from contact end to snare end, respectively protrudes out of the ends of the base (81) and has a shaft (821) and a slider (822).

The shaft (821) is mounted rotatably through the base (81) and has a contact end, a snare end and a head (8211). The contact end of the shaft (821) protrudes out of the contact end of the base (81). The snare end of the shaft (821) is threaded. The head (821) is attached securely to the contact end of the shaft (821).

The slider (822) is mounted slidably in the base (81), is mounted rotatably around the snare end of the shaft (821) and has a snare end and a snare mount (8221). The snare end of the slider (822) protrudes out of the snare end of the base (81). The snare mount (8221) is mounted on the snare end of the slider (822), is attached to the end of the snare and is moved upward and downward when the head (821) is rotated to adjust tension of the snare and change the timbre.

However, in use, beating the drum causes the timbre to change because vibrations cause the slider (822) to unwind along the shaft (821) allowing the snare to become slack, meaning the head must be readjusted when performing to ensure high sound quality. However, this distracts a player's concentration and may cause mistiming, missed cues or the like.

To overcome the shortcomings, the present invention provides a snare-adjusting device for a snare drum to mitigate or obviate the aforementioned problems.

SUMMARY OF THE INVENTION

The main objective of the invention is to provide a snare-adjusting device for a snare drum that maintains tension of a snare steadily.

The snare-adjusting device is mounted on the snare drum for adjusting tension of the snare and has a base, adjustment assembly and snare mount. The adjustment assembly is mounted through the base and has a barrel, shaft, slider, adjustment head and friction ring. The barrel has two ends. The shaft is mounted rotatably through the barrel. The slider is mounted slidably in and engages one end of the barrel and is mounted on the shaft using threads. The adjustment head is mounted securely on the shaft. The friction ring is mounted slidably through an other end of the barrel, is pressed by a resilient device to abut the adjustment head and provide friction against rotation of the adjustment head. The snare mount is attached to the slider and connects to the snare. The friction holds the adjustment head securely to maintain a steady timbre.

Other objectives, advantages and novel features of the invention will become more apparent from the following detailed description when taken in conjunction with the accompanying drawings.

DETAILED DESCRIPTION OF PREFERRED EMBODIMENT

Figure 1:
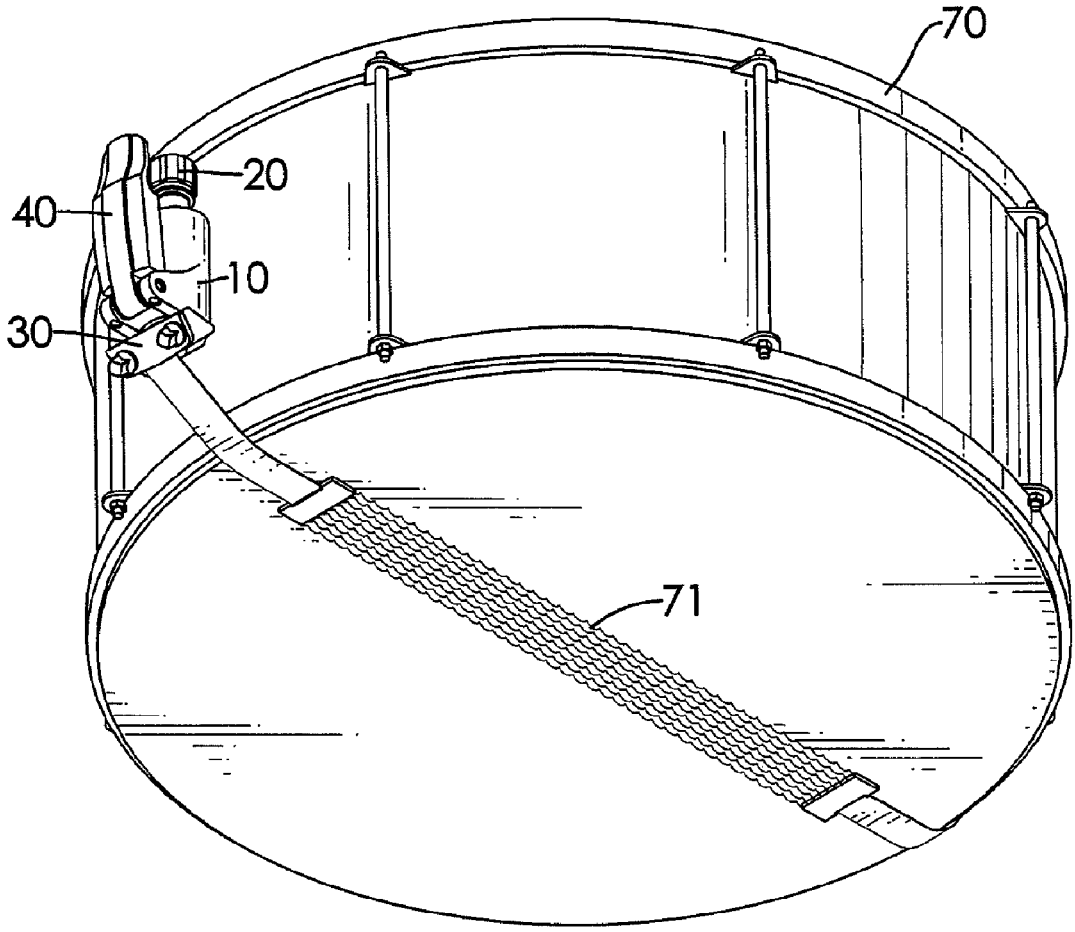
FIG. 1 is an operational bottom perspective view of a snare-adjusting device for a snare drum in accordance with the present invention mounted on a snare drum.
Figure 2:
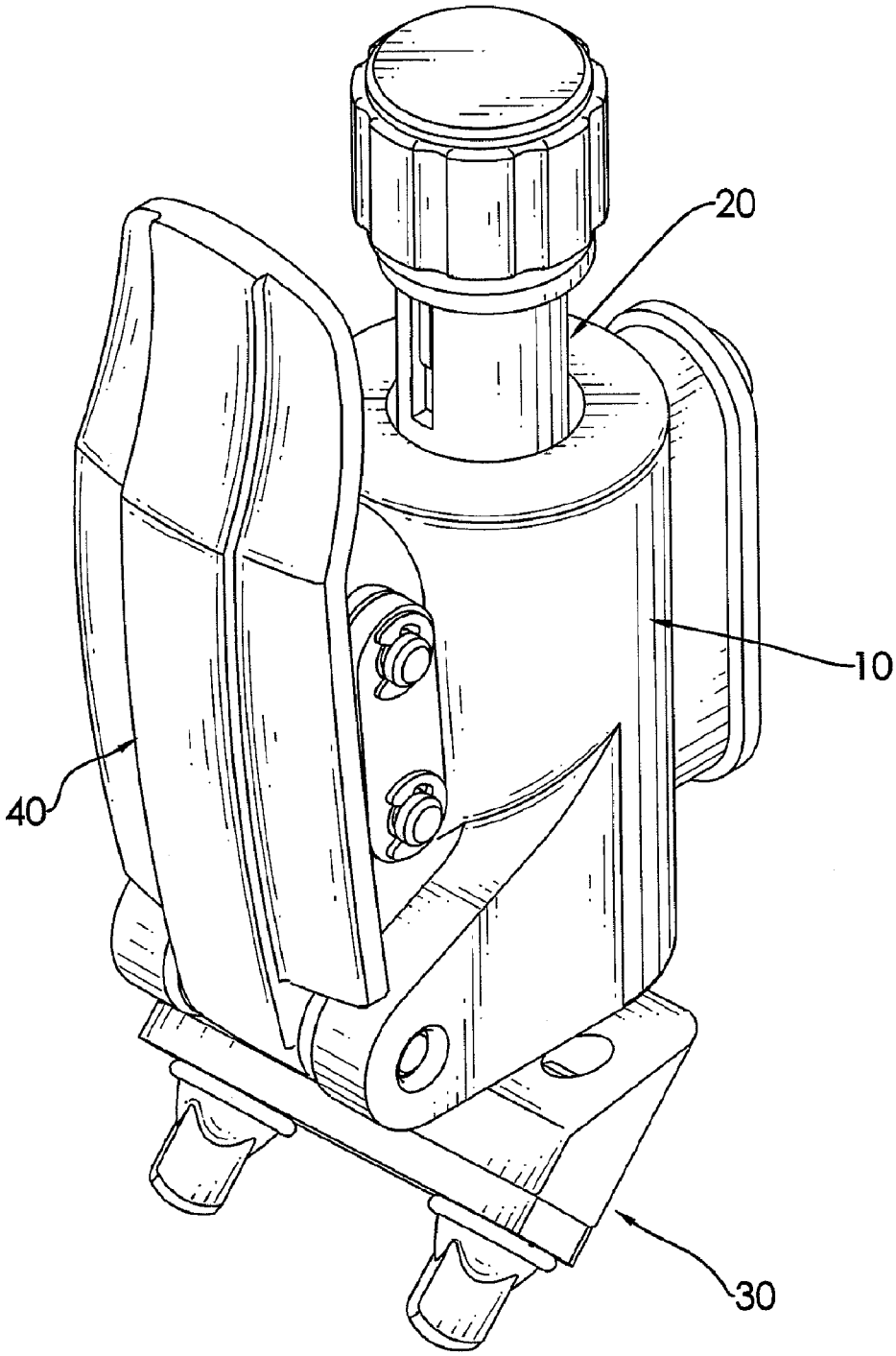
FIG. 2 is a top perspective view of the snare-adjusting device in FIG. 1.

With reference to FIGS. 1 and 2, a snare-adjusting device in accordance with the present invention is mounted on a snare drum (70). The snare drum (70) has a body and a snare (71). The body is an open cylinder having an annular sidewall, a contact end, a snare end and skins mounted over each opening. The snare (71) is mounted on the snare end and has two ends. The ends of the snare (71) are mounted on the annular sidewall of the body of the snare drum (70).

The snare-adjusting device in accordance with the present invention is mounted on the annular sidewall of the body, is attached to one of the ends of the snare (71) and comprises a base (10), an adjustment assembly (20), a snare mount (30) and an optional quick release (40).

Figure 3:
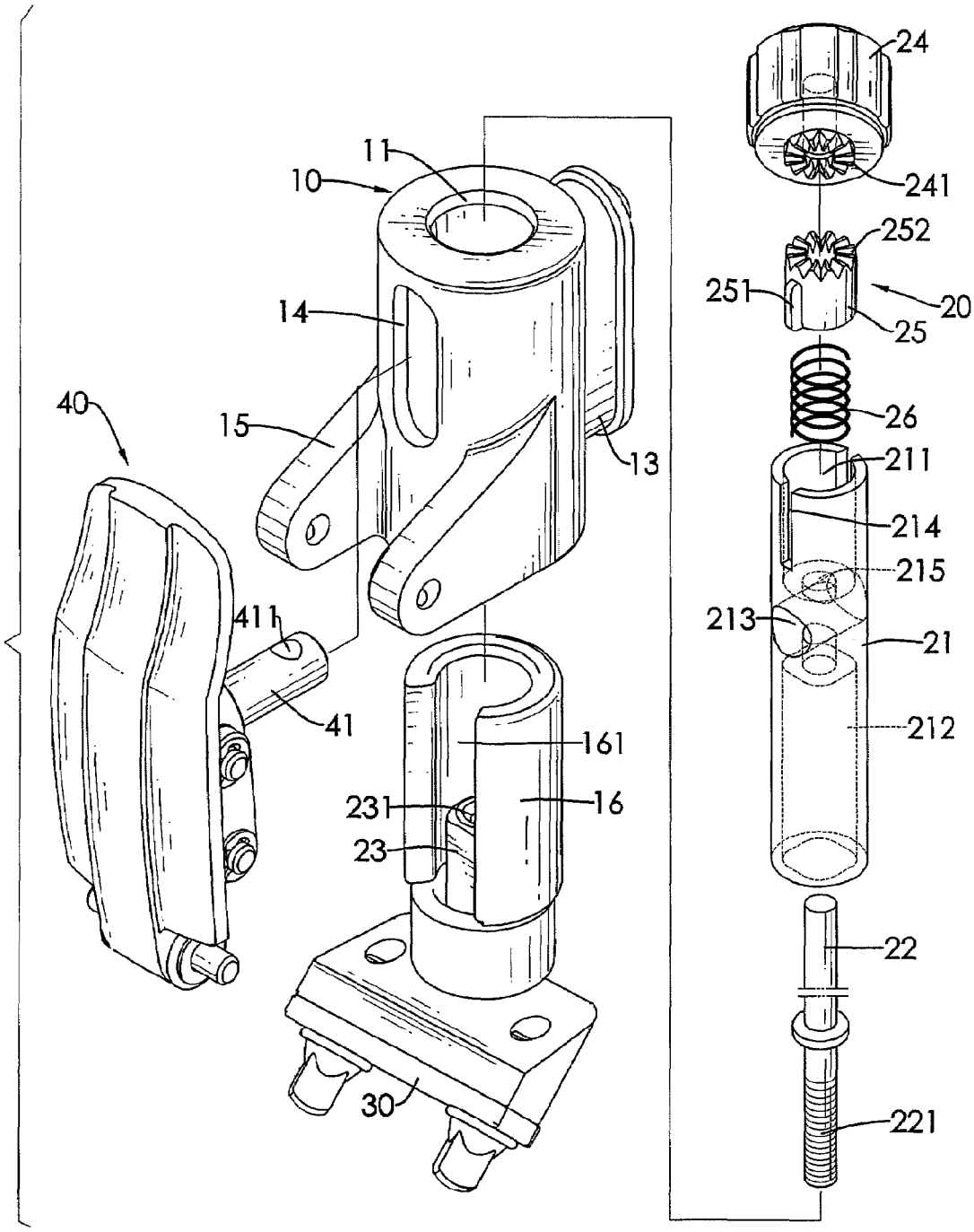
FIG. 3 is an exploded perspective view of the snare-adjusting device in FIG. 2.
Figure 4:
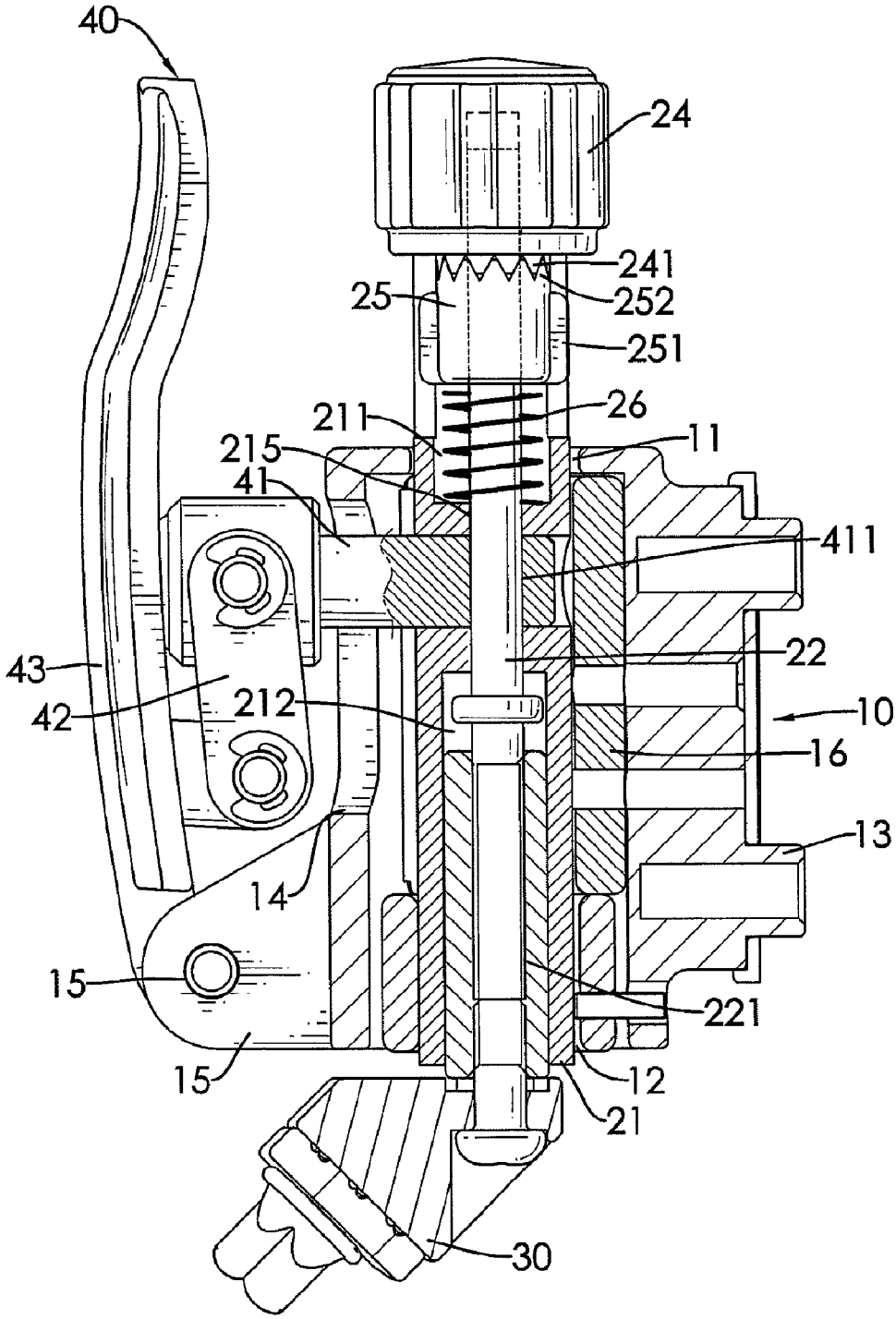
FIG. 4 is a side view in partial section of the snare-adjusting device in FIG. 1 in a first operational embodiment.

With further reference to FIGS. 3 and 4, the base (10) is attached to the annular sidewall of the body of the snare drum (70), has an adjustment end, a mounting end, a through hole, a sidewall and may have a mounting bracket (13), a slide slot (14), a pivot bracket (15) and a sleeve (16).

The mounting end is opposite to the adjustment end.

The through hole is formed through the base (10) from mounting end to adjustment end.

The mounting bracket (13) is attached to the sidewall of the base (10) and is attached securely to the annular sidewall of the body of the snare drum (70) to mount the base (10) on the body of the snare drum.

The slide slot (14) is formed parallelly with the through hole in the sidewall of the base (10).

The pivot bracket (15) is formed on the sidewall of the base (10) near the mounting end.

The sleeve (16) is cylindrical, is mounted in the through hole and has an annular sidewall and a slit (161). The slit (161) is formed in the annular sidewall of the sleeve (16) is parallel to and aligns with the slide slot (14).

The adjustment assembly (20) is mounted slidably through the through hole of the base (10), protrudes out from both ends and has a barrel (21), a shaft (22), a slider (23), an adjustment head (24), a friction ring (25) and a resilient device (26).

The barrel (21) is mounted in the through hole of the base (10), may be in the sleeve (16) and has a first end, a second end, a shaft hole (215), an optional connecting hole (213), a recess (211), a slide cavity (212) and at least one optional stop (214).

The first end of the barrel (21) corresponds to the adjustment end of the base (10).

The second end of the barrel (21) is opposite to the first end of the barrel (21).

The shaft hole (215) is formed concentrically through the barrel (21).

The connecting hole (213) is formed transversely through the barrel (21) and communicates with the shaft hole (215).

The recess (211) is formed concentrically in the first end of the barrel (21) and communicates with the shaft hole (215).

The slide cavity (212) is formed concentrically in the second end of the barrel (21), is keyed and communicates with the shaft hole (215).

The at least one stop (214) is formed longitudinally on the first end of the barrel (21).

The shaft (22) is mounted rotatably through the barrel (21), is mounted rotatably through the shaft hole (215) and has an adjustment end and a threaded end (221).

The adjustment end of the shaft (22) protrudes out of the adjustment end of the base (10).

The threaded end (221) is opposite to the adjustment end of the shaft (22) and is disposed in the slide cavity (212).

The sldier (23) is mounted slidably in the slide cavity (212), engages the slide cavity (212), is mounted rotatably on the threaded end (221) of the shaft (22), so slides along the slide cavity (212) when the shaft (22) is rotated and has an outer end and a threaded hole (231).

The threaded hole (231) is formed longitudinally through the slider (23), engages and is mounted on the threaded end (221) of the shaft (22).

The adjustment head (24) is attached securely to the adjustment end of the shaft (22), allows the shaft (22) to be rotated easily, abuts the first end of the barrel (21) and has an inner surface (241).

The inner surface (241) of the adjustment head (24), corresponds to the recess (211) of the barrel (21), is a frictional surface and may comprise multiple teeth.

The friction ring (25) is mounted slidably around the shaft (22) near the adjustment end, is mounted slidably in the recess (211) of the barrel (21), engages the barrel (21) to prevent rotation, corresponds to and abuts the inner surface (241) of the adjustment head (24) and has an outer surface (252) and at least one optional stop (251).

The at least one stop (251) is formed on the friction ring (25) and slidably engages the at least one stop (214) of the barrel (21).

The outer surface (252) of the friction ring (25), corresponds to and temporarily engages the inner surface (241) of the adjustment head (24), is a frictional surface and may comprise multiple teeth.

The resilient device (26), may be a torsional spring, is mounted between the friction ring (25) and the barrel (21) and presses the friction ring (25) against the adjustment head (24) to selectively prevent rotation between the inner surface (241) of the adjustment head (24) and the outer surface (252) of the friction ring.

The snare mount (30) is attached securely to the outer end of the slider (23) and connects to the corresponding end of the snare (71).

Figure 5:
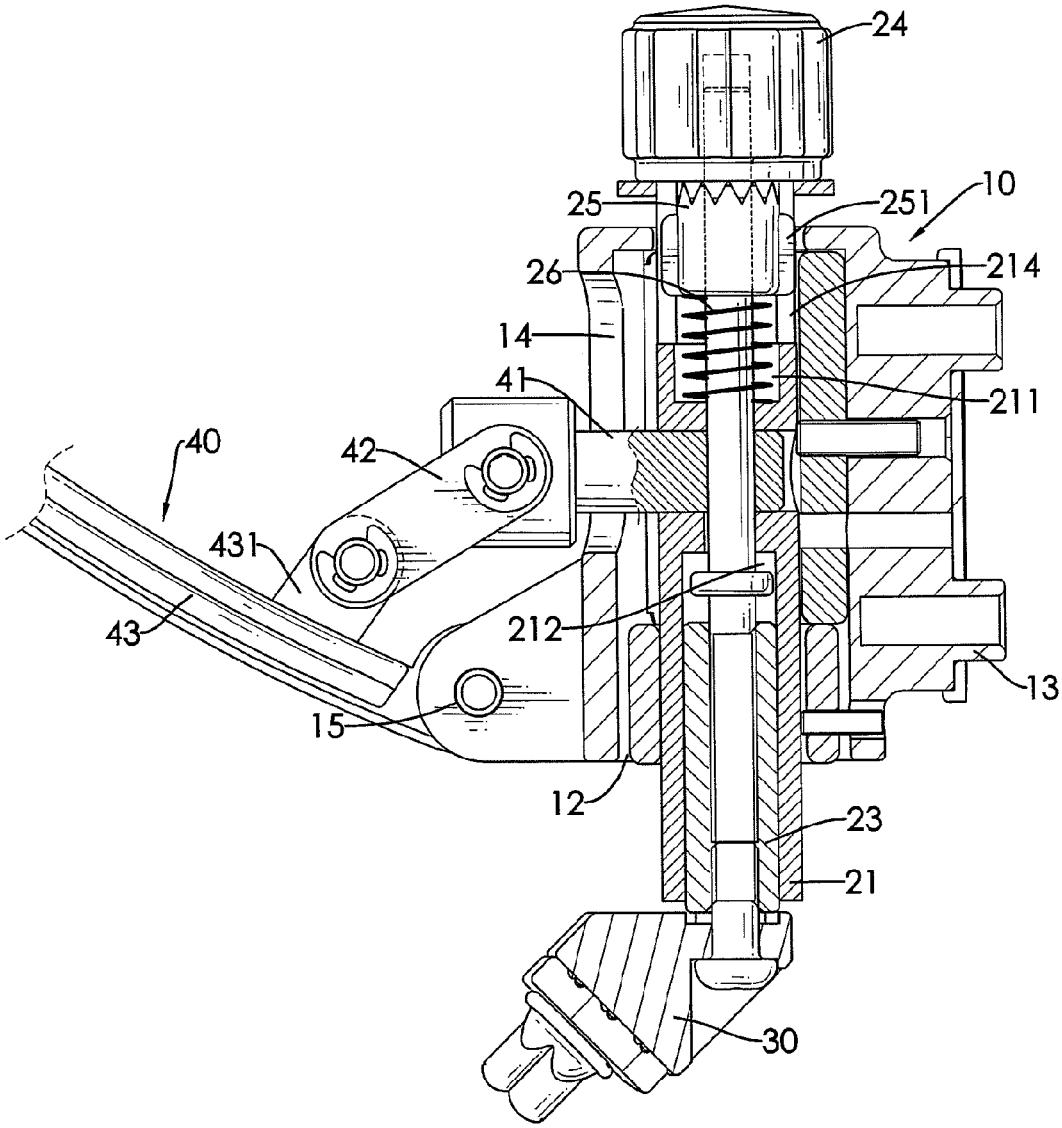
FIG. 5 is an operational side view in partial cross section of the snare-adjusting device in FIG. 1 in a second operational embodiment.
Figure 6:
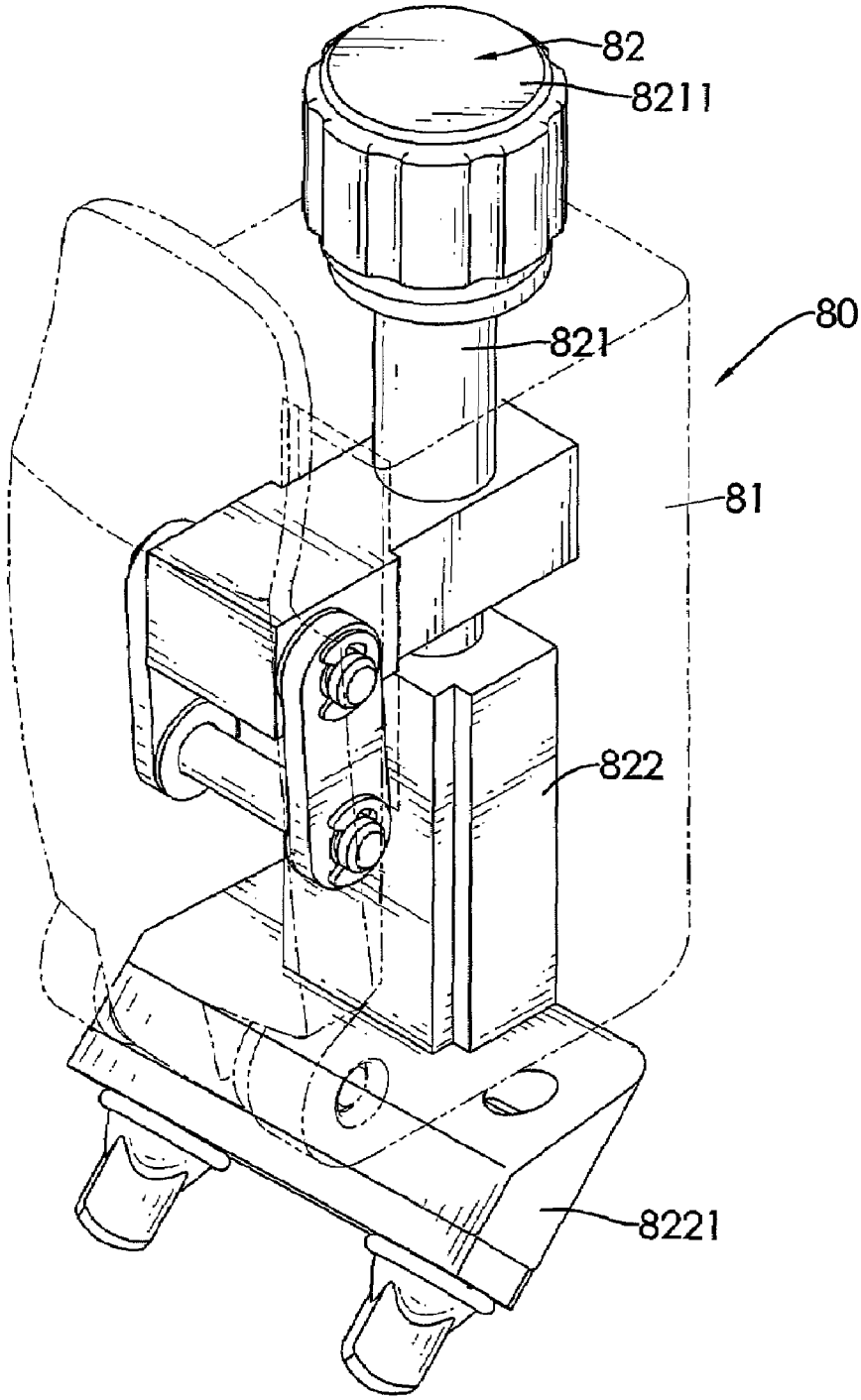
FIG.6 PRIOR ART
FIG. 6 is a perspective view of a conventional snare-adjusting device in accordance with the prior art, partially shown in phantom lines.

With further reference to FIG. 5, the quick release (40) is attached to the sidewall of the base (10) corresponding to the slide slot (14), connects to the adjustment assembly (20), allows the user rapidly adjust tension in the snare (71) by sliding the adjustment assembly (20) and the snare mount (30) relative to the base (10) and has an engaging rod (41), a couple (42) and a lever (43).

The engaging rod (41) is mounted slidably through the slide slot (14) and the slit (161) and rotatably on the shaft (22) and has an inner end, an outer end and a rotate hole (411).

The inner end of the engaging rod (41) is mounted through and engages the connecting hole (213) of the barrel (21) and is mounted rotatably around the shaft (22).

The outer end of the engaging rod (41) protrudes out of the slide slot (14) of the base (10).

The rotate hole (411) is formed in the inner end of the engaging rod (41) and is mounted rotatably around the shaft (22).

The couple (42) has a connecting end and a lever end.

The connecting end of the couple (42) is mounted pivotally on the outer end of the engaging rod (41).

The lever (43) has a pivoting end and a pivot mount (431).

The pivoting end of the lever (43) is mounted pivotally on the pivot bracket (15) and allows the lever to pivot relative to the base (10).

The pivot mount (431) is formed on and protrudes from the lever (43) and is mounted pivotally on the lever end of the couple (42) to allow the adjustment assembly (20) to be moved by pivoting the lever (43) relative to the pivot bracket (15) of the base (10).

Therefore, the quick release (40) allows for quick fitting of the snare (71) to the drum body (70) and allows the snare (71) to be detached easily. Furthermore, the friction between the adjustment head (24) and the friction ring (25) prevents the adjustment head (24) from being slipping unexpectedly so maintains tension in the snare (71) and gives constant for the timbre during use.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A snare-adjusting device for a snare drum comprising:

a base having an adjustment end;

a mounting end being opposite to the adjustment end;

a through hole being formed through the base from mounting end to adjustment end; and a sidewall;

an adjustment assembly being mounted slidably through the through hole of the base, protruding out from both ends of the base and having a barrel being mounted in the through hole of the base and having a first end corresponding to the adjustment end of the base;

a second end being opposite to the first end of the barrel;

a shaft hole being formed concentrically through the barrel;

a recess being formed concentrically in the first end of the barrel and communicating with the shaft hole of the barrel; and a slide cavity being formed in the second end of the barrel, being keyed and aligning with the shaft hole;

a shaft being mounted rotatably through the shaft hole of the barrel and having an adjustment end protruding out of the adjustment end of the base; and a threaded end being opposite to the adjustment end of the shaft and being disposed in the slide cavity;

a slider being mounted slidably in the slide cavity, engaging the slide cavity, being mounted rotatably on the threaded end of the shaft and having an outer end; and a threaded hole being formed longitudinally through the slider, engaging and being mounted on the threaded end of the shaft;

an adjustment head being attached securely to the adjustment end of the shaft and having an inner surface corresponding to the recess of the barrel and being a frictional surface;

a friction ring being mounted slidably around the shaft, being mounted slidably in the recess of the barrel, engaging the barrel, abutting the inner surface of the adjustment head and having an outer surface corresponding to and temporarily engaging the inner surface of the adjustment head and being a frictional surface; and a resilient device being mounted between the friction ring and the barrel and pressing the friction ring against the adjustment head; and a snare mount being attached securely to the outer end of the slider.

2. The snare-adjusting device as claimed in claim 1, wherein the base further has a slide slot being formed parallelly with the through hole in the sidewall of the base; and a pivot bracket being formed on the sidewall of the base near the mounting end;

the barrel of the adjustment assembly further has a connecting hole being formed transversely through the barrel and communicating with the shaft hole of the barrel; and the adjusting-device further comprises a quick release being attached to the sidewall of the base corresponding to the slide slot, connecting to the adjustment assembly and having an engaging rod being mounted slidably through the slide slot of the base and having an inner end being mounted through and engaging the connecting hole of the barrel and being mounted rotatably around the shaft;

an outer end protruding out of the slide slot of the base; and a rotate hole being formed in the inner end of the engaging rod and being mounted rotatably around the shaft;

a couple having a connecting end being mounted pivotally on the outer end of the engaging rod; and a lever end; and a lever having a pivoting end being mounted pivotally on the pivot bracket of the base; and a pivot mount being formed on and protruding from the lever and being mounted pivotally on the lever end of the couple.

3. The snare-adjusting device as claimed in claim 2, wherein the inner surface of the adjustment head and the outer surface of the friction ring comprise multiple teeth selectively engaging each other.

4. The snare-adjusting device as claimed in claim 3, wherein the barrel has at least one stop being formed longitudinally on the first end of the barrel; and the friction ring has at least one stop being formed on the friction ring and respectively engaging slidably the at least one stop of the barrel.

5. The snare-adjusting device as claimed in claim 4, wherein the base has a mounting bracket being attached to the sidewall of the base.

6. The snare-adjusting device as claimed in claim 5, wherein the base has a sleeve being cylindrical, being mounted in the through hole of the base and having an annular sidewall; and a slit being formed in the annular sidewall of the sleeve being parallel to and aligning with the slide slot of the base.

7. The snare-adjusting device as claimed in claim 6, wherein the resilient device is a torsional spring.

* * * * *